US009443646B2

(12) United States Patent
Armbrecht et al.

(10) Patent No.: US 9,443,646 B2
(45) Date of Patent: Sep. 13, 2016

(54) DATA CABLE

(71) Applicant: ROSENBERGER HOCHFREQUENZTECHNIK GMBH & CO. KG, Fridolfing (DE)

(72) Inventors: Gunnar Armbrecht, Mühlforf am Inn (DE); Thomas Müller, Berchtesgaden (DE); Michael Wollitzer, Fridolfing (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/373,112

(22) PCT Filed: Jan. 21, 2013

(86) PCT No.: PCT/EP2013/000174

§ 371 (c)(1),
(2) Date: Jul. 18, 2014

(87) PCT Pub. No.: WO2013/107655

PCT Pub. Date: Jul. 25, 2013

(65) Prior Publication Data

US 2015/0034358 A1 Feb. 5, 2015

(30) Foreign Application Priority Data

Jan. 19, 2012 (DE) ..... 10 2012 000 935

(51) Int. Cl.

| | |
|---|---|
| ***H01B 7/18*** | (2006.01) |
| ***H01B 11/00*** | (2006.01) |
| ***H01B 11/20*** | (2006.01) |

(52) U.S. Cl.
CPC ..... *H01B 11/005* (2013.01); *H01B 11/20* (2013.01)

(58) Field of Classification Search
CPC ..... H01B 1/20; H01B 1/22; H01B 1/24; H01B 5/002; H01B 5/004; H01B 11/20; H01B 11/005; H01B 11/006
USPC ..... 174/102 R, 108, 109, 110 R, 174/110 AS–110 PM, 113 R, 120 R, 106 R, 174/103
See application file for complete search history.

(56) References Cited

U.S. PATENT DOCUMENTS

| | | | | |
|---|---|---|---|---|
| 4,096,346 | A * | 6/1978 | Stine et al. | 174/36 |
| 5,939,668 | A * | 8/1999 | De Win | 174/36 |
| 5,956,445 | A * | 9/1999 | Deitz et al. | 385/100 |
| 6,403,887 | B1 * | 6/2002 | Kebabjian et al. | 174/110 R |
| 6,452,107 | B1 * | 9/2002 | Kebabjian | 174/113 R |
| 6,686,537 | B1 * | 2/2004 | Gareis et al. | 174/36 |
| 6,815,611 | B1 * | 11/2004 | Gareis | 174/36 |

(Continued)

FOREIGN PATENT DOCUMENTS

| | | | | |
|---|---|---|---|---|
| DE | 29907039 U1 | 8/2000 | | |
| DE | 29907039 U1 * | 10/2000 | | H01B 11/00 |

(Continued)

*Primary Examiner* — William H Mayo, III
(74) *Attorney, Agent, or Firm* — DeLio, Peterson & Curcio, LLC; Robert Curcio

(57) ABSTRACT

A data cable with at least two conductors for a differential transmission of data signals as well as a casing which surrounds the conductors. Each of the conductors has a conductor shield. The data cable uses asymmetrical data signals transmitted together with differential data signals via at least one of the at least two conductors.

20 Claims, 5 Drawing Sheets

(56) References Cited

U.S. PATENT DOCUMENTS

| | | | | |
|---|---|---|---|---|
| 7,923,638 | B2 * | 4/2011 | Kaczmarski | 174/110 R |
| 8,039,749 | B2 * | 10/2011 | Okano et al. | 174/113 R |
| 8,546,690 | B2 * | 10/2013 | Masakazu et al. | 174/103 |
| 9,018,529 | B2 * | 4/2015 | Sidlyarevich | 174/110 R |
| 2003/0121694 | A1 * | 7/2003 | Grogl et al. | 174/113 R |
| 2005/0011664 | A1 * | 1/2005 | Lee | 174/102 SC |
| 2008/0314613 | A1 * | 12/2008 | Huang et al. | 174/107 |
| 2009/0260849 | A1 * | 10/2009 | Cardas | 174/114 R |
| 2010/0051318 | A1 * | 3/2010 | Wang | 174/113 R |
| 2010/0084157 | A1 * | 4/2010 | Wang | 174/107 |
| 2010/0258333 | A1 | 10/2010 | Horan | |

FOREIGN PATENT DOCUMENTS

| | | | | |
|---|---|---|---|---|
| WO | WO 98/33189 | A1 * | 7/1998 | H01B 7/00 |
| WO | WO 02/103715 | A1 * | 12/2002 | H01B 11/02 |

* cited by examiner

DATA CABLE

BACKGROUND OF THE INVENTION

1. Field of the Invention

The invention relates to a data cable with at least two conductors for differential signal transmission as well as a casing, in particular one made of an electrically insulating material, which surrounds the conductors.

2. Description of Related Art

During the transmission of the differential or symmetrical signals, identical data signals are transmitted via at least two conductors with opposite polarity. The two conductors of the cable are so designed that all inductive and capacitive interference affects these as identically as possible. The interference can then be eliminated through formation of the differential between the two signals.

It is known for cables to be used for data transmission in which four conductors are provided in a so-called star quad arrangement. Such a cable can provide two differential signal pairs, wherein the two conductors diagonally opposite one another in the star quad each faun a differential conductor pair. A significant advantage of the star quad arrangement is that each of the conductor pairs always lies in the virtual ground plane of the other conductor pair. This makes it possible to realize a high crosstalk attenuation while at the same time keeping the cable as compact as possible. The highest possible crosstalk attenuation is necessary in order to be able to transmit mutually independent broadband data streams on both conductor pairs without harmful mutual interference.

Current star quad cables reach their limits at data rates >2 GBit/s, as provided for, for example, in the USB 3.0 (USB: Universal Serial Bus) or MHL (Mobile High Definition Link) standard, in particular where long cable lengths are involved. In particular, mode conversion, crosstalk and cable attenuation all increase at higher frequencies.

The document DE 299 07 039 U1 discloses a data transmission cable with several insulated conductors, each with a closed metal sleeve on the surface of the conductor insulation. The conductors can be surrounded by an intermediate casing, a metal sleeve covering this and an outer casing.

SUMMARY OF THE INVENTION

Bearing in mind the problems and deficiencies of the prior art, it is therefore an object of the present invention to provide a data cable so designed that all inductive and capacitive interference affects these as identically as possible.

The above and other objects, which will be apparent to those skilled in the art, are achieved in the present invention which is directed to a data cable comprising: at least two conductors for a differential transmission of data signals; a casing surrounding the conductors, wherein each of the at least two conductors includes a conductor shield; and an additional common shielding in the form of a collective shield, wherein the conductor shields are in electrical contact with the collective shield.

The data cable may include four conductors are arranged in a star quad configuration, and the conductors may be stranded.

Two opposite conductors of the data cable may possess a conductor shield and the two other conductors may not possess a conductor shield.

The data cable may include at least one filler strand, and the filler strand(s) may be electrically conductive.

The data cable may include an intermediate jacketing arranged between the conductors and the collective shield, wherein the intermediate jacketing is poorly conductive.

The space between the casing, collective shield, and the conductors may be at least partially filled with a non-electrically conductive filler.

In a second aspect, the present invention is directed to a data cable and plug connector combination comprising: a data cable having at least two conductors for a differential transmission of data signals; a casing surrounding the conductors, wherein each of the at least two conductors includes a conductor shield; and an additional common shielding in the form of a collective shield, wherein the conductor shields are in electrical contact with the collective shield, and wherein the collective shield of the data cable is connected in an electrically conductive manner with an outer conductor of the plug connector and the conductors of the data cable are connected in an electrically conductive manner with inner conductors of the plug connector.

In a third aspect, the present invention is directed to a method of using a data cable having at least two conductors for a differential transmission of data signals; a casing surrounding the conductors, wherein each of the at least two conductors includes a conductor shield; and an additional common shielding in the form of a collective shield, wherein the conductor shields are in electrical contact with the collective shield, and wherein differential data signals and asymmetrical data signals are transmitted via at least one of the at least two conductors.

In a fourth aspect, the present invention is directed to a method of using the data cable and plug combination wherein the data cable includes at least two conductors for a differential transmission of data signals; a casing surrounding the conductors, wherein each of the at least two conductors includes a conductor shield; and an additional common shielding in the form of a collective shield, wherein the conductor shields are in electrical contact with the collective shield, and wherein differential data signals as well as common mode signals are transmitted via two conductors equipped with a conductor shield and two conductors are used to transmit electrical supply energy and/or signals with a lower data rate.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
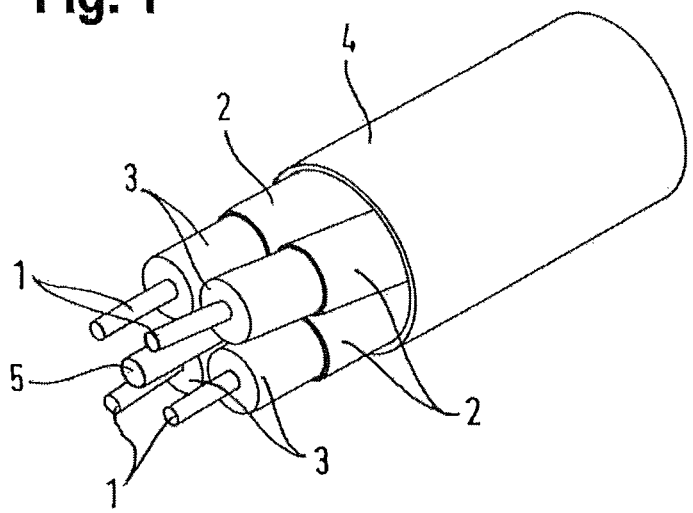
FIG. 1 shows an isometric view of an end of a data cable according to the invention, without collective shield, in a first embodiment.

In describing the preferred embodiment of the present invention, reference will be made herein to FIGS. 1-10 of the drawings in which like numerals refer to like features of the invention.

Starting out from this prior art, the invention was based on the problem of further improving a data cable, in particular a star quad cable, in order to make possible, in particular, the transmission of high data rates (>2 GBit/s) in adequately good quality.

This problem is solved through the subject matter of the independent claim 1. Advantageous embodiments of the data cable according to the invention are the subject matter of the dependent claims and are explained in the following description of the invention. A unit consisting of a data cable according to the invention and a plug connector is the subject matter of the ancillary claim 9. Advantageous uses of the data cable according to the invention are the subject matter of the ancillary claims.

According to the invention, the transmission capacity of the data cable with at least two conductors surrounded by a (non-electrically-conductive) casing (made, for example, of polypropylene or polyvinylchloride) for differential signal transmission is to be improved in that the conductors each possess a conductor shield, i.e. a cladding made of an electrically-conductive material which is separated from the conductor by means of an insulator, wherein the conductors are surrounded by an additional common shielding in the form of a collective shield which is in electrical contact with the conductor shields.

The (electrically-conductive) conductors can, for example, consist of copper and can be in the form of a solid or stranded wire. The impedance of one of the conductors can (in single-ended mode) preferably amount to 50 Ω, so that a differential impedance for the conductor pair of 100 Ω results. However, other conductor impedances, for example 75 Ω (in single-ended mode) can be practical for special applications, for example for the transmission of video data signals.

The insulator can for example consist of a (substantially) electrically non-conductive plastic, for example polypropylene, polytetrafluoroethylene. The insulator can also completely fill the intervening space between the conductors and the respective conductor shield or can be in the form of one or more conductor sheaths which secure the position of the conductor within the respective conductor shield, the rest of the intervening space being filled with a (substantially) non-electrically-conductive fluid and in particular gas, for example air.

Preferably, according to the invention, a data cable in known star quad configuration is further developed in that at least two, or possibly all four conductors according to the invention are provided with a conductor shield.

Preferably, the four conductors can also be stranded. In conventional star quad cables, stranding serves to increase the coupling attenuation of the differential conductor pair(s) with respect to the environment. However, since the shielding of the individual conductors according to the invention already minimizes coupling between them, a stranding of the conductors in a data cable according to the invention for electrical reasons may not be necessary. However, the flexibility and the mechanical integrity of the cable can in any case be improved through stranding.

In an embodiment of the data cable according to the invention, two of the four conductors (diagonally opposite one another in the star quad arrangement) can be intended for the transmission of data signals and the two other conductors for the transmission of electrical (supply) energy. Such a data cable is, accordingly, suitable for combined data transmission and energy supply of components, as is known for example from the USB standard. In such an embodiment, the conductor shields can be dispensed with in the case of the conductors intended for the transmission of electrical energy.

In a further preferred embodiment, a guide element is arranged between the conductors. This can be provided in order to guarantee the stability of the symmetrical arrangement of the conductors. The guide element can be designed in the form of one or more filler strands. The filler strands can—in particular where the data cable is in star quad arrangement—be arranged in the intervening space formed by the four conductors and/or—whatever the design of the data cable between the conductors and the casing.

Preferably, the filler strands can be electrically conductive. This also allows the EMC behavior (EMC: electromagnetic compatibility) of the data cable to be improved.

According to the invention, all of the conductors are provided with an (additional) common shielding (collective shield), i.e. a common electrically-conductive cladding. This allows, in particular, an improvement in the EMC behavior of the data cable to be achieved. Under certain circumstances this additional collective shield can also lead to an increase in the shielding effect of the conductor shields. The collective shield can be designed in any faun, for example as a braided shield or as a foil shield (for example in the form of a plastic film metallized on one or both sides).

In addition, according to the invention the collective shield and the conductor shields can thereby be in electrical contact, as a result of which, on the one hand, the electrical shield effect can be improved, and on the other hand this can simplify the connection of the data cable according to the invention to existing electrical components, for example plug connectors, in particular the HSD series. This makes it possible, for example, to connect the collective shield with an outer conductor of such a plug connector, as a result of which this outer conductor is simultaneously connected, in an electrically-conductive manner, with the conductor shields of the data cable. This allows a complex connection of the individual conductor shields with the outer conductor of a plug connector to be dispensed with during the manufacture of the data cable. The electrical contact between the collective shield and the conductor shields is preferably made directly, or indirectly via an electrically-conductive element (a "conductor"), whereby a poorly electrically conductive ("poorly conductive") element is also a conductor.

Accordingly, the invention relates to a unit consisting of (at least) one data cable according to the invention with a collective shield in contact with the conductor shields and (at least) one plug connector in which the collective shield is connected electrically with an outer conductor of the plug connector and the conductors are connected electrically with inner conductors of the plug connector.

In order to improve the electrical and mechanical properties of the data cable, a poorly electrically conductive (i.e. subject to losses) intermediate jacketing can be provided between the conductors and the collective shield.

According to the invention, poorly electrically-conductive or "poorly conductive" (in some cases also referred to as "semiconducting") is understood to refer to a conductivity which lies between that of conductors, in particular metals, for example copper, and non-conductive materials or insulators.

The electromagnetic energy coupled out through the conductor shields, especially towards low frequencies at which a conductor shield in the form of a foil shield displays a diminishing shielding effect, is attenuated within a poorly conductive intermediate jacketing and in this way the external collective shield can display its full shielding effect.

In a further preferred embodiment, the space between the casing and the conductors (or their conductor shields), in particular the void formed between the conductors and the casing and/or the between the conductors (or their conductor shields) themselves is at least partially filled with a (preferably (substantially) non-electrically-conductive) filler. This can, in particular, improve the mechanical stability of the data cable.

The crosstalk between the conductors can be reduced through the individual shielding of the conductors of a data cable, preferably in star quad arrangement, according to the invention. In addition, influences on mode conversion which result from interference points and/or asymmetries in a stranding of the conductors can be reduced. The propagation of higher order modes along the conductor, in particular from propagable mode formers such as result from the plurality of conductors involved in conventional star quad data cables, above all at high operating frequencies, can also be suppressed. This reduces the losses along the data cable and its transmission performance is improved. Consequently, this allows the maximum possible (given adequate transmission quality) operating frequency of the data cable to be increased.

The data cable according to the invention is also suitable, advantageously, not only for differential transmission, but also simultaneously for the asymmetrical transmission of data signals in which the transmission of signals is effected through a change in signal voltage in comparison with a reference potential. A use according to the invention of the data cable according to the invention therefore involves, in addition to differential data signals, asymmetrical data signals also being transmitted via at least one, preferably both of the at least two conductors. In particular, the conductor shields of the individual conductors can serve as reference potential (ground). According to the invention the asymmetrical transmission of data signals of the same polarity via two conductors (which are simultaneously used for differential data transmission) is referred to as "common mode" transmission. The individual shielding of the conductors of the data cable not only improves crosstalk attenuation during differential data transmission (push-pull transmission) but also during "common mode" transmission.

The superimposition of differential data signals and asymmetrical data signals according to the invention allows the transmission rate to be further increased while maintaining good transmission quality. In particular, the actual data signals can be transmitted differentially via the conductors and a so-called "clock signal" at a lower rate (approx. 1 MBit/s) can be superimposed in common mode. At the receiver, the signals can then be separated again into differential and common mode by means of relatively simple circuits.

Due to the individual shielding of the conductors, the field of the common mode-signals is concentrated in equal strength between the inner conductor and conductor shield of the conductor pair(s) which are provided for the differential transmission of data signals. Without the conductor shields, the common mode signal would propagate between the conductors and a collective shield which is generally used. The crosstalk to adjacent conductor pairs would therefore be significantly higher.

In the case of a data cable with (at least) two conductor pairs provided with individual conductor shields, in particular a data cable in a star quad configuration, both differential data signals and common mode data signals (in particular a "clock" signal) can be transmitted via all (both) conductor pairs.

On the other hand, in the case of a data cable according to the invention which comprises more than the at least two conductors, each provided with a conductor shield, differential data signals as well as common mode signals (for example a "clock" signal) can be transmitted via the conductor pair(s) provided with individual conductor shields and electrical supply energy and/or signals with a lower data rate (for example control signals) can be transmitted (in single-ended mode) via the additional (preferably two) conductors.

The data cable according to the invention can thus replace a plurality of individual cables, helping reduce the thickness of typical cable harnesses.

Figure 2:
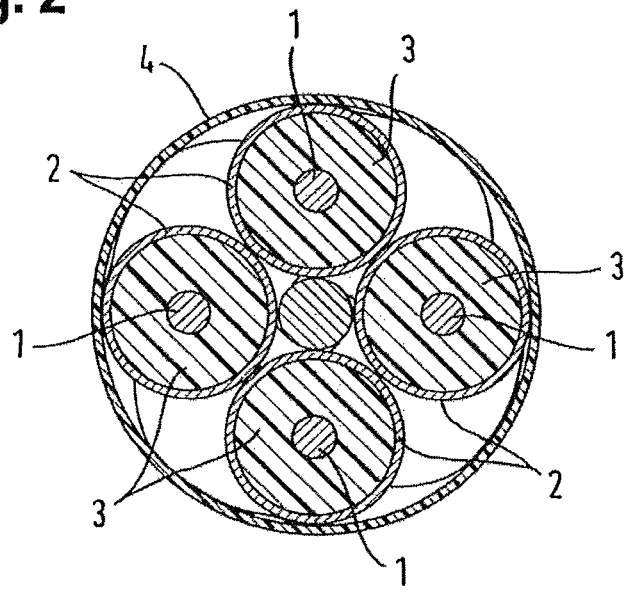
FIG. 2 shows the data cable according to FIG. 1 in cross section.

The data cable illustrated in FIGS. 1 and 2 comprises four coaxial conductors which are arranged in a so-called star quad configuration and which are also stranded. The (inner) conductor 1 of each of these coaxial conductors is used for the transmission of data signals or electrical energy and according to the invention is surrounded by a conductor shield 2 (outer conductor). An insulator 3 establishes a non-electrically-conductive connection between the conductor 1 and the associated conductor shield 2.

The coaxial conductors are surrounded by a casing 4 which is made of a non-electrically-conductive plastic, which protects the coaxial conductors against damage and insulates the conductor shields 2 electrically from the environment. The fact that the casing 4 is formed so as to lie in direct contact with the coaxial conductors also ensures that these remain in the symmetrical star quad arrangement.

A filler stand 5 is arranged between the four coaxial conductors, improving the stability of the star quad arrangement.

Figure 3:
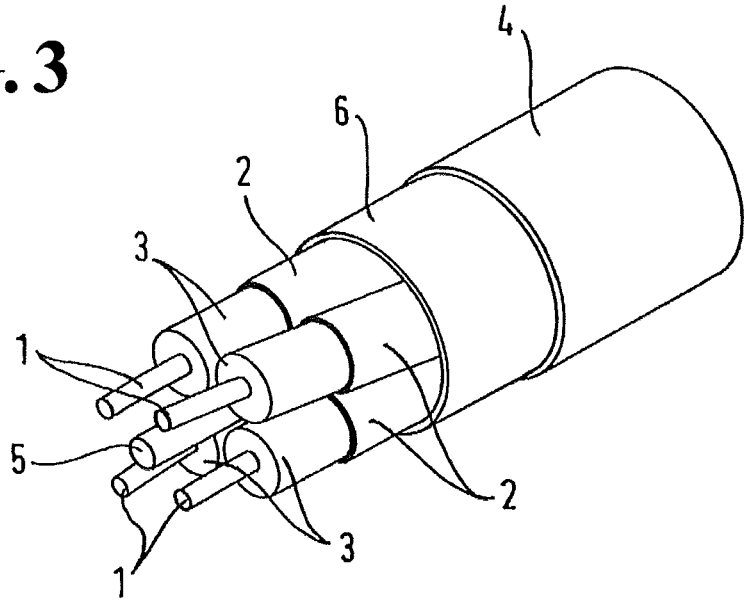
FIG. 3 shows an isometric view of an end of a data cable according to the invention in a first embodiment.
Figure 4:
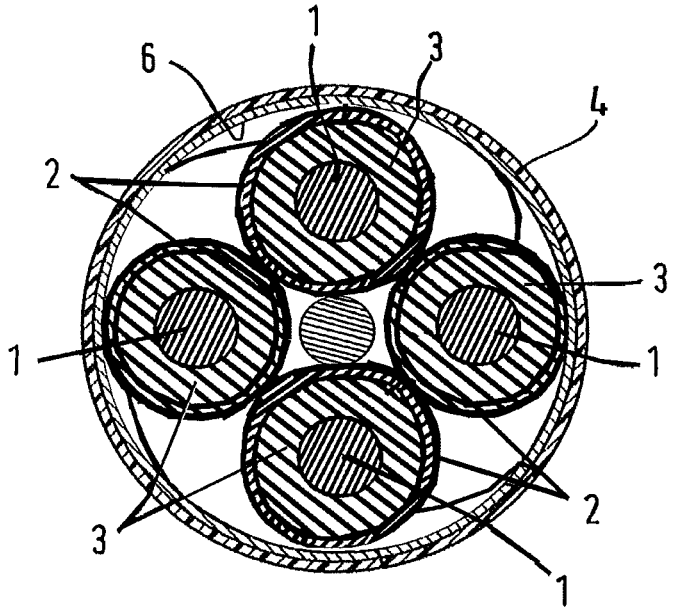
FIG. 4 shows the data cable according to FIG. 3 in cross section.

The first embodiment of a data cable according to the invention represented in FIGS. 3 and 4 differs from that shown in FIGS. 1 and 2 in the additional arrangement of a collective shield 6 between the coaxial conductors and the casing 4. The collective shield 6 surrounds all the coaxial conductors and improves, in particular, the EMC behavior of the data cable. The collective shield 6 is thereby in contact with the conductor shields (2) of all coaxial conductors.

Figure 5:
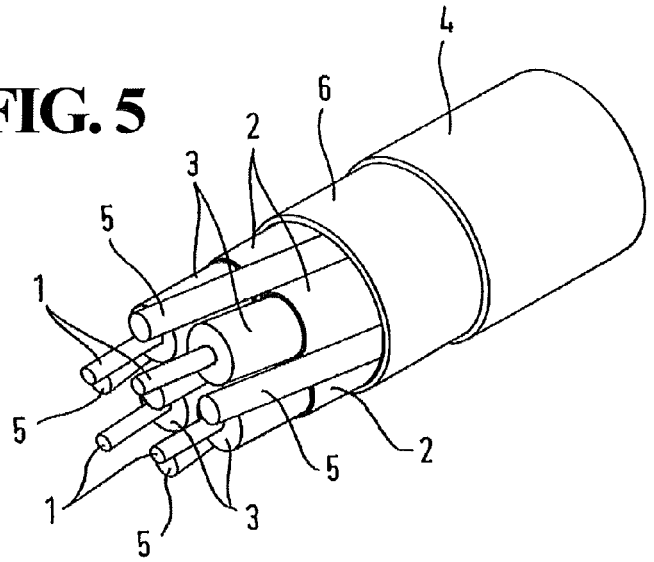
FIG. 5 shows an isometric view of an end of a data cable according to the invention in a second embodiment.
Figure 6:
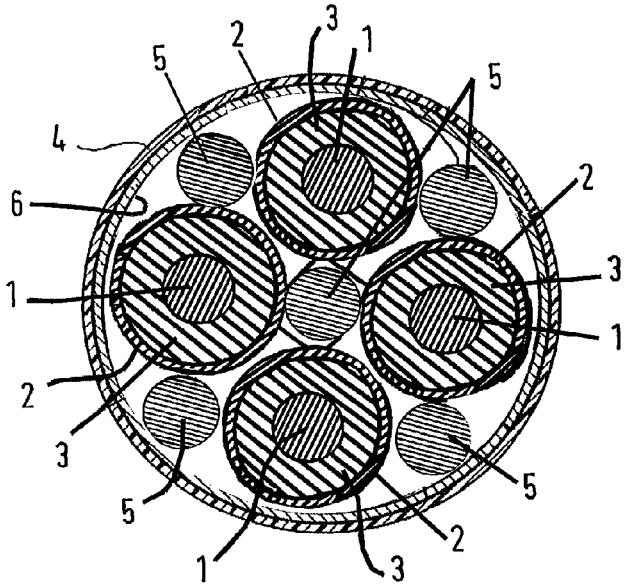
FIG. 6 shows the data cable according to FIG. 5 in cross section.

The second embodiment of a data cable according to the invention shown in FIGS. 5 and 6 is provided with additional filler strands 5 in comparison with that shown in FIGS. 3 and 4. In addition to the filler strands 5 arranged in the intervening space formed by the four coaxial conductors, in each case a further filler strand 5 is arranged within the total of four intermediate spaces (so called voids) formed between each pair of coaxial conductors or their conductor shields 2 and the collective shield 6. In total, five filler strands 5 are thus provided. In this embodiment too, the collective shield 6 and conductor shields 2 of all coaxial conductors are in contact.

Figure 7:
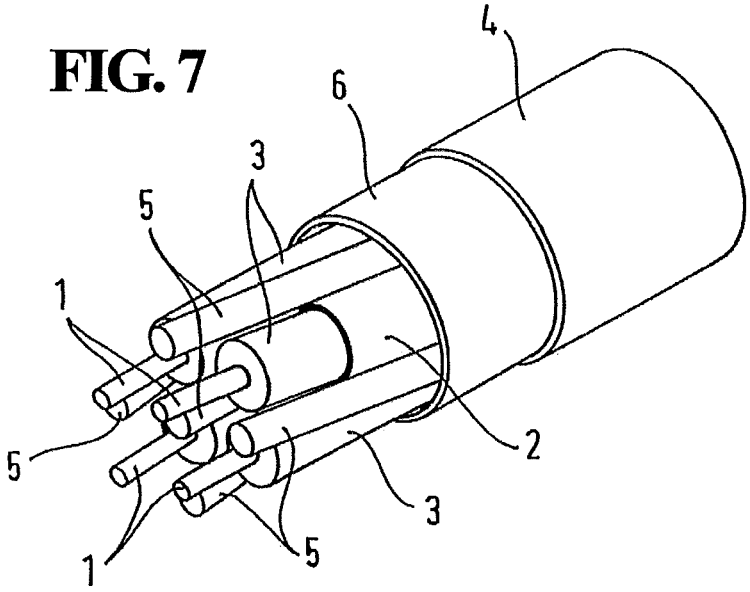
FIG. 7 shows an isometric view of an end of a data cable according to the invention in a third embodiment.
Figure 8:
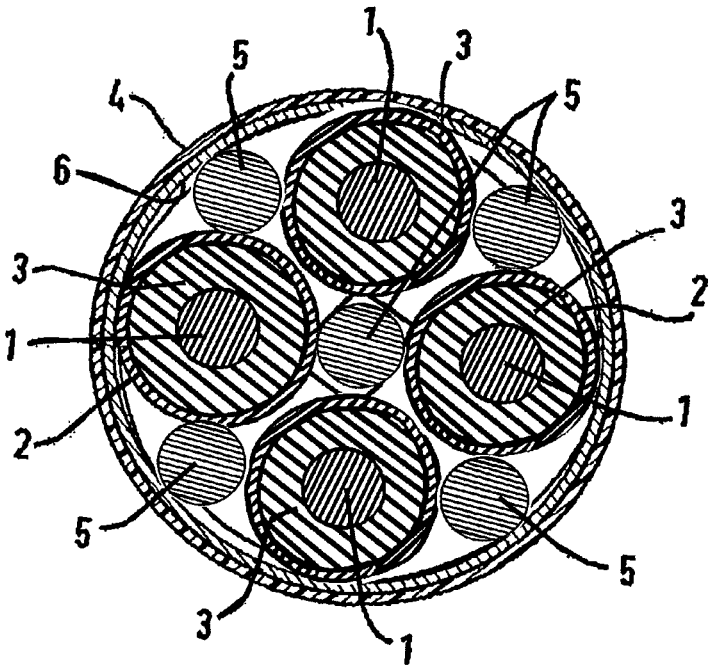
FIG. 8 shows the data cable according to FIG. 7 in cross section.

The third embodiment of a data cable according to the invention illustrated in FIGS. 7 and 8 differs from that shown in FIGS. 5 and 6 in that only two of the four conductors 1 are surrounded by a conductor shield 2 (which is in contact with the collective shield 6). Here, the two conductors 1 formed as coaxial conductors, i.e. those provided with conductor shields 2, lie opposite one another in the star quad arrangement, which allows the advantageous differential transmission of the data signals to take place. Such a data transmission also only takes place via the conductors 1 provided with conductor shields 2, whereas the two other conductors 1 which are not provided with conductor shields 2 are intended for the transmission of electrical (supply) energy and/or signals with a lower data rate.

Figure 9:
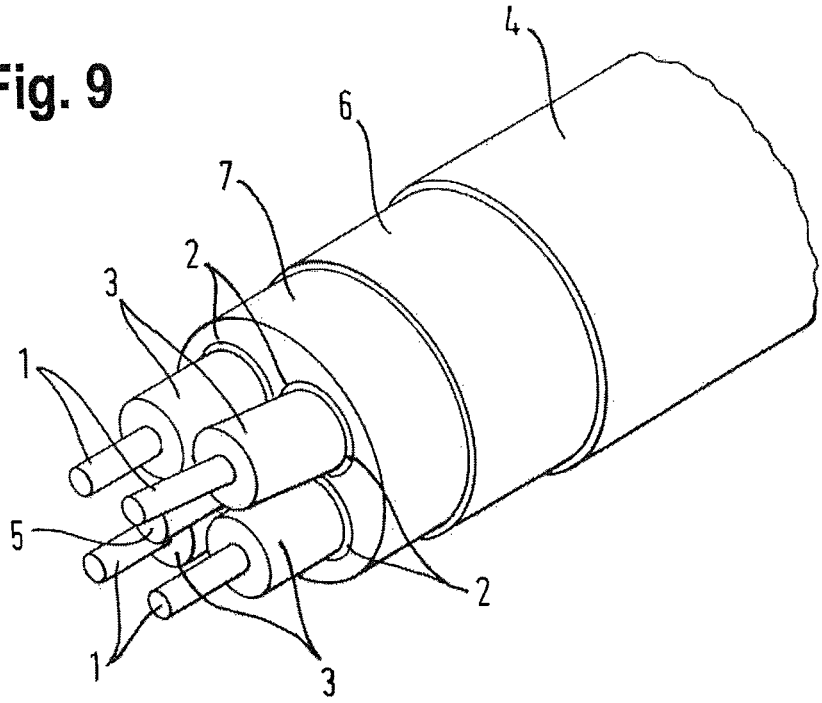
FIG. 9 shows an isometric view of an end of a data cable according to the invention in a fourth embodiment.
Figure 10:
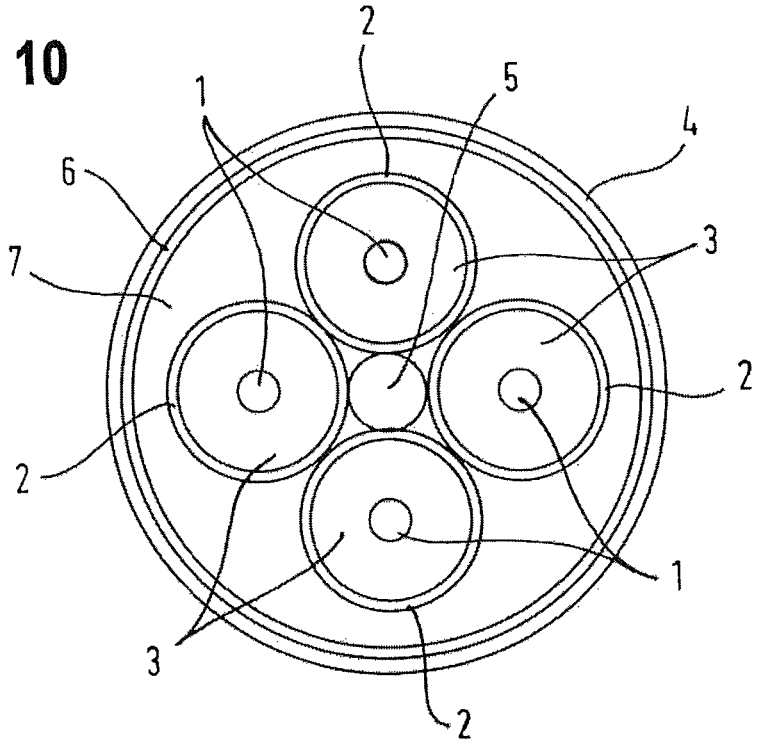
FIG. 10 shows the data cable according to FIG. 9 in cross section.

The fourth embodiment of a data cable according to the invention illustrated in FIGS. 9 and 10 differs from that shown in FIGS. 3 and 4 in that an intermediate jacketing 7 is provided which is arranged between the coaxial conductors and the collective shield 6. The intermediate jacketing 7 is made of a poorly-conductive material.

The possibility, represented in FIGS. 7 and 8, of only providing two of the four coaxial conductors with a conductor shield 2 is naturally also possible in the embodiments shown in FIGS. 9 and 10.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A data cable comprising:

at least two conductors for a differential transmission of data signals;

a casing surrounding the conductors, wherein each of the at least two conductors includes a conductor shield; and are surrounded by an additional common shielding in the form of a collective shield, wherein the conductor shields are in electrical contact with the collective shield; and an immediate jacketing arranged between the conductors and the collective shield, wherein the intermediate jacketing is poorly conductive.

2. The data cable of claim 1, wherein four conductors are arranged in a star quad configuration.

3. The data cable of claim 2, wherein the conductors are stranded.

4. The data cable of claim 3, wherein two opposite conductors possess a conductor shield and the two other conductors do not possess a conductor shield.

5. The data cable of claim 4, including at least one filler strand.

6. The data cable of claim 4, wherein the filler strand is electrically conductive.

7. The data cable of claim 4, including an intermediate jacketing arranged between the conductors and the collective shield, wherein the intermediate jacketing is poorly conductive.

8. The data cable of claim 3, including at least one filler strand.

9. The data cable of claim 3, including an intermediate jacketing arranged between the conductors and the collective shield, wherein the intermediate jacketing is poorly conductive.

10. The data cable of claim 3, wherein the space between the casing, collective shield, and the conductors is at least partially filled with a non-electrically conductive filler.

11. The data cable of claim 2, wherein two opposite conductors possess a conductor shield and the two other conductors do not possess a conductor shield.

12. The data cable of claim 11, wherein the space between the casing, collective shield, and the conductors is at least partially filled with a non-electrically conductive filler.

13. The data cable of claim 2, including at least one filler strand.

14. The data cable of claim 13, wherein the filler strand is electrically conductive.

15. A method of using the data cable of claim 2, wherein differential data signals as well as common mode signals are transmitted via two conductors equipped with a conductor shield and two conductors are used to transmit electrical supply energy and/or signals with a lower data rate.

16. The data cable of claim 1, wherein the space between the casing, collective shield, and the conductors is at least partially filled with a non-electrically conductive filler.

17. A data cable and plug connector combination comprising: a data cable according to claim 1, wherein the collective shield of the data cable is connected in an electrically conductive manner with an outer conductor of the plug connector and the conductors of the data cable are connected in an electrically conductive manner with inner conductors of the plug connector.

18. A method of using a data cable according to claim 1, wherein differential data signals and asymmetrical data signals are transmitted via at least one of the at least two conductors.

19. A method of using the data cable and plug combination of claim 17, wherein differential data signals as well as common mode signals are transmitted via two conductors equipped with a conductor shield and two conductors are used to transmit electrical supply energy and/or signals with a lower data rate.

20. A method of using a data cable according to claim 1, wherein the data cable is connected in an electrically conductive manner with an outer conductor of a plug connector and the conductors of the data cable are connected in an electrically conductive manner with inner conductors of the plug connector, such that differential data signals and asymmetrical data signals are transmitted via at least one of the at least two conductors.

* * * * *